United States Patent [19]

Wilson et al.

[11] 4,105,445

[45] Aug. 8, 1978

[54] RESILIENT ARCUATE SURFACE CONTAINING PHOTOCONDUCTOR

[75] Inventors: Lional Agustin Wilson, Redbourn; John Wales, Bishop's Stortford; William Ernest George Plumtree, Ware, all of England

[73] Assignee: Xerox Corporation, Stamford, Conn.

[21] Appl. No.: 567,575

[22] Filed: Apr. 14, 1975

[30] Foreign Application Priority Data

May 29, 1974 [GB] United Kingdom ..... 23709/74

[51] Int. Cl.[2] ..... G03G 5/04

[52] U.S. Cl. ..... 96/1.5 R; 29/117; 427/15; 96/1 LY; 118/661

[58] Field of Search ..... 96/1 LY, 1.5; 118/DIG. 23; 427/15; 29/113, 117

[56] References Cited

U.S. PATENT DOCUMENTS

| | | | |
|---|---|---|---|
| 763,251 | 6/1904 | Breck | 29/117 |
| 1,863,286 | 6/1932 | Sheppard | 29/113 R |
| 3,040,754 | 6/1962 | Lear | 29/117 |
| 3,559,570 | 2/1971 | Mattel et al. | 96/1 |
| 3,801,315 | 4/1974 | Gundlach et al. | 96/1.4 |

*Primary Examiner*—Roland E. Martin, Jr.
*Assistant Examiner*—John Goodrow
*Attorney, Agent, or Firm*—J. J. Ralabate; A. A. Mahassel; E. O. Palazzo

[57] ABSTRACT

A novel liquid developing system is disclosed which employs a rigid member adapted so that it is resilient when employed in operating contact with another rigid member. The resilient member is normally arcuate in configuration and includes a rigid support member and a flexible arcuate surface spaced apart by a resilient member and a means for tensioning the resilient member so that the spacing tension is reduced in an amount sufficient to allow easy movement of the flexible surface with respect to the resilient member.

8 Claims, 5 Drawing Figures

RESILIENT ARCUATE SURFACE CONTAINING PHOTOCONDUCTOR

BACKGROUND OF THE INVENTION

The invention is related to the field of electrostatography and more specifically to liquid developing systems employed therein.

The formation and development of images on an imaging surface which may be the surface of a photoconductor, by electrostatic means is well known. The basic xerographic process, as disclosed by C. F. Carlson in U.S. Pat. No. 2,297,691 involves placing a uniform electrostatic charge on a photoconductive insulating layer exposing the layer to a light-and-shadow image to dissipate and charge on the areas of the layer exposed to the light, and developing the resulting charge pattern by depositing on the image a finely-divided marking material referred to in the art as "toner". The toner will normally be attracted to those areas of the layer which retain a charge, thereby forming a toner image corresponding to the charge image. This powder image may then be transferred to a support surface such as paper. The transferred image may subsequently be permanently affixed to a support surface as by heat. Instead of latent image formation by uniformly charging a photoconductive layer and then exposing the layer to a light-and-shadow image, one may form the charge pattern by directly charging an imaging surface in image configuration. The powder image may be fixed to the imaging surface if elimination of the powder image transfer step is desired. Other suitable means such as solvent or overcoating treatment may be substituted for the foregoing heat fixing steps.

Several methods are known for applying a developer to a charge pattern to be developed. One development method as disclosed by E. N. Wise in U.S. Pat. No. 2,618,552 is known as "cascade" development. Another method of developing charge patterns is the "magnetic brush" process as disclosed for example, in U.S. Pat. No. 2,874,063. Still another development technique is the "powder cloud" process as disclosed by C. F. Carlson in U.S. Pat. No. 2,221,776.

An additional dry development system involves developing a charge pattern with a powdered developer material, the powder having been uniformly applied to the surface of a powder applicator. The charge pattern is brought close enough to the developer powder applicator so that the developer powder is pulled from the powder applicator to the charge bearing image in image configuration. The charge pattern and powder applicator may desirably be brought in contact including contact under pressure to effect development. The powder applicator may be either smooth surfaced or roughened so that the developer powder is carried in the depressed portions of the patterned surface. Exemplary of this system are the techniques disclosed by H. G. Greig in U.S. Pat. No. 2,811,465.

Liquid development may also be employed in the development of charge patterns. In conventional liquid development, more commonly referred to as electrophoretic development, an insulating liquid vehicle having finely divided solid material dispersed therein contacts the imaging surface in both charged and uncharged areas. Under the influence of the electric field associated with the charged image pattern the suspended particles migrate toward the charged portions of the imaging surface separating out of the insulating liquid. This electrophoretic migration of charged particles results in the deposition of the charged particles on the imaging surface in image configuration.

An additional liquid technique for developing charge patterns is the liquid development process disclosed by R. W. Gundlach in U.S. Pat. No. 3,084,043. In this method, a charge pattern is developed or made visible by presenting to the imaging surface a liquid developer on the surface of a developer dispensing member having a plurality of raised portions defining a substantially regular patterned surface and a plurality of portions depressed below the raised portions. The depressed portions contain a liquid developer which is maintained out of contact with the imaging surface. When the raised areas of the developer applicator are brought into contact with the imaging surface bearing a charge pattern the developer creeps up the sides of raised portions in contact only with the charged area of the imaging surface, and is deposited thereon.

This technique is to be distinguished from conventional liquid development wherein there is an electrophoretic movement of charged particles suspended in a liquid carrier vehicle to the charged portion of the image bearing surface while the liquid substantially remains on the applicator surface and serves only as a carrier medium. In the liquid development method described by R. W. Gundlach in U.S. Pat. No. 3,084,043 the liquid phase actively takes part in the development of the image since the entire liquid developer is attracted to the charged portions of the image bearing surface. Furthermore, in the liquid development method described by R. W. Gundlach unlike conventional liquid development, the developer liquid contacts only the charged portions of the image bearing surface.

A further liquid development technique is that referred to as "wetting development" or selective wetting as described in U.S. Pat. No. 3,285,741. In this technique an aqueous developer uniformly and continously contacts the entire imaging surface and due to the selected wetting and electrical properties of the developer substantially only the charged areas of the normally hydrophobic imaging surface are wetted by the developer. The developer should be relatively conductive having a resistivity generally from about $10^5$ to $10^{10}$ ohm cm and have wetting properties such that the wetting angle measured when the developer is placed on the imaging surface is smaller than 90° at the charged areas and greater than 90° in the uncharged areas.

In a compact electrostatographic copying device employing the development techniques disclosed by R. W. Gundlach, the imaging surface and the liquid developer applicator are desirably small diameter cylinders or the like, to facilitate the cooperative movement of the surfaces in contact during development in a confined space. Such moving contact between the imaging surface and the applicator resulting in the transfer of liquid developer from the applicator to the photoreceptor occurs at development speeds ranging generally from about 2 to about 70 inches per second.

Prior imaging surfaces and the applicators have generally been rigid and have been manufactured by machining large castings to the proper diameter within precise tolerances. A functional surface such as a photoconductive film or a patterned applicator surface may subsequently be applied to the casting to achieve the necessary high degree of precision desirable for the proper functioning of the surface in an electrostatographic apparatus. Although, these prior imaging and applicator surfaces reproduce a large volume of high quality images before replacement is required, an appreciable savings of time, money and effort may be realized by employing a special expandable support cylinder as an integral part of the machine to allow the replacement of a substantially less expensive relatively thin outer sleeve.

It has been proposed in copending application of Stephen C. P. Hwa, entitled Roller Arrangement, filed in the name of Xerox Corporation Sept. 7, 1973 (UK application No. 42182/73) that one of the cooperating surfaces (either the photoreceptor or the applicator) be deformable, having a hardness of from about 30° to 90° (shore A durometer) while retaining the functional integrity of its operative surface. The use of a deformable surface when at least one of such surfaces is arcuate, provides substantially uniform contact and a substantially uniform nip width between the surfaces.

Such an arrangement in effect compensates for a range of dimensional irregularities in the non-deformable surface so that substantially uniform density, good image quality and high resolution are achieved in the final copy. Resilient imaging and applicator surfaces are desirable to obtain good density and resolution, particularly in connection with the development method disclosed by R. W. Gundlach in U.S. Pat. No. 3,084,043.

A method of making a resilient surface, especially one for use in accordance with the techniques of S. C. P. Hwa as described above is sought. Such a surface which is capable of being assembled easily, without special tools and at the site of use is desirable.

It is, therefore, an object of this invention to provide a development system devoid of the above noted deficiencies.

A further object of this invention to provide an improved resilient arcuate surface.

Another object of this invention is to provide a novel development system.

Those and other objects of this invention are accomplished generally speaking by for example providing a resilient arcuate member which comprises a rigid support member and a flexible arcuate surface spaced apart by a resilient member and a means for tensioning the resilient member in such a way that the spacing dimension is reduced an amount sufficient to allow easy movement of the flexible surface with respect to the resilient member.

In another embodiment of the instant invention there is provided a method for assembling a resilient arcuate member which comprises providing a rigid support, a flexible arcuate surface, a resilient member and an extending means for the resilient member; tensioning the extending means so that the resilient member is reduced in one dimension an amount sufficient to allow placement of the resilient member between the rigid support and the flexible surface; placing the resilient member between the rigid support and the flexible surface; and relaxing the tension on the extending means so that the flexible sleeve is placed apart from the support means.

When the resilient member is in a relaxed position, it is under sufficient compression between the flexible surface and the support means to prevent the surface from moving easily with respect to the support and to impart a functional firmness to the flexible surface. The resilient member may be tensioned so that its spacing dimension is reduced. Such a reduction relaxes the compression between the flexible surface and the support means sufficient to allow easy movement of the flexible surface with respect to the support means.

Resilient arcuate members according to the invention will now be described by way of example with reference to the accompanying drawings in which.

Figure 4A:
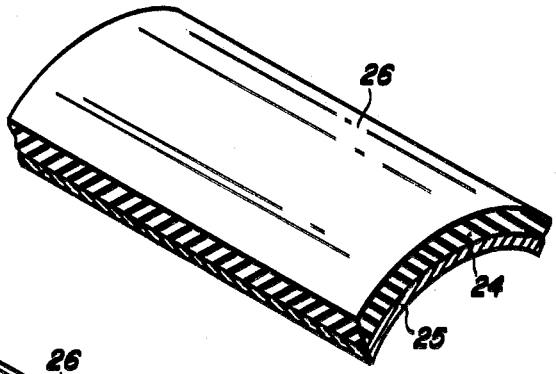
Figure 4B:
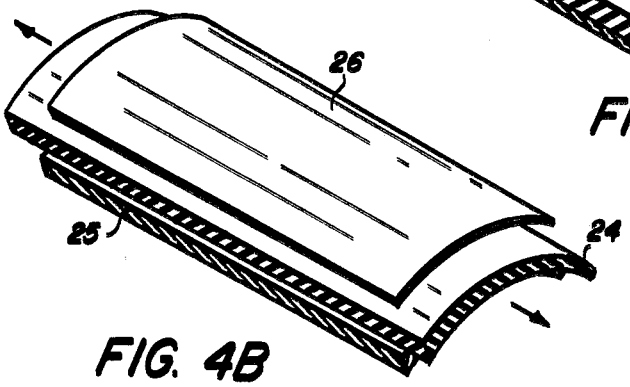

FIG. 4*a* and 4*b* shows in perspective yet another embodiment of a resilient arcuate member in accordance with this invention.

Figure 1:
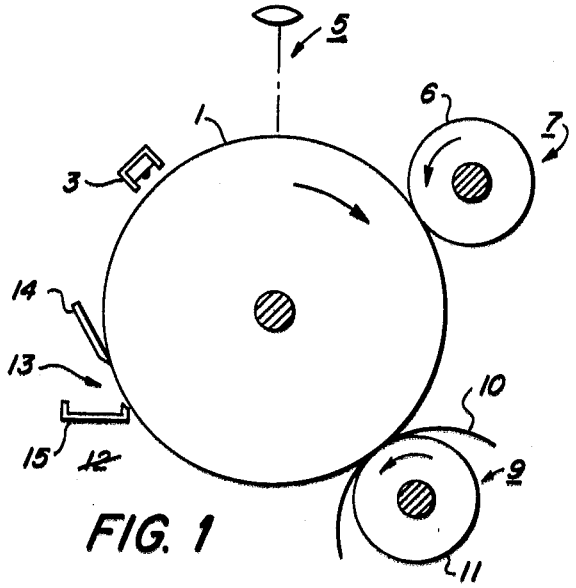
FIG. 1 is a schematic representation of a simplified xerographic system showing the various major process steps and the relationships which the resilient arcuate member of this invention may have to the major process stations.

Referring now to FIG. 1 there is shown a xerographic member generally designated 1, which in this exemplary instance, may be photoconductive selenium coated on a conductive drum. Alternatively, the xerographic member 1 could be charged, for example, by frictional contact. Charged member 1 is then exposed to a light image at the exposure station generally designated 5. The charge surface, being photoconductive, when exposed to light to which it is responsive will become conductive in light struck areas allowing the surface charge to move through to the conductive drum leaving a pattern of charge on the surface of the drum corresponding to the non-light stuck areas. The electrostatic image thus formed is then made visible at developing station generally 7 where developer is applied to the photoconductive surface. Developing station 7 may be, for example, a roller 6 supplied with a controlled amount of liquid developer. If the xerographic member 1 is a resilient roll the developer applicator roller 6 is generally rigid. However, if the xerographic member is a rigid roller, the developer applicator roller 6 is generally a resilient roll in accordance with the present invention and as more fully described in connection with FIG. 2. In this exemplary instance, the liquid developer is brought into a developing relationship with the xerographic member 1, so that the liquid developer is deposited on the charged areas in accordance with the teachings of R. W. Gundlach substantially as set out in U.S. Pat. No. 3,084,043. However, the developer roll may also be used to bring developer into contact with the imaging member 1 in accordance with, for example, the teachings of U.S. Pat. No. 3,285,741 to develop the charged areas. Alternatively by proper selection of liquid developer materials under operating conditions, the toner can be made to deposit on background or non-charged areas in a well known process called "reversal" development as disclosed, for example, in U.S. Pat. No. 2,817,598. Whatever development technique is used, the image now visible is transferred to a receiver member at transfer station generally designated 9. At transfer station 9, receiver member 10 which may be, for example, paper entrained over roller 11 is pressed into contact with the toner image on member 1. The developer is thus transferred to the receiver member forming the final copy. The transfer of developer to the receiver member may be assisted by applying an electrical field of the proper polarity between roller 11 and drum 1. Finally there is shown a cleaning station designated generally as 13. In the exemplary embodiment of FIG. 1 cleaning station 13 comprises a doctor blade 14 which removes excess developer from the surface of the xerographic member 1 so that it drops to collector tray 15.

Figure 2:
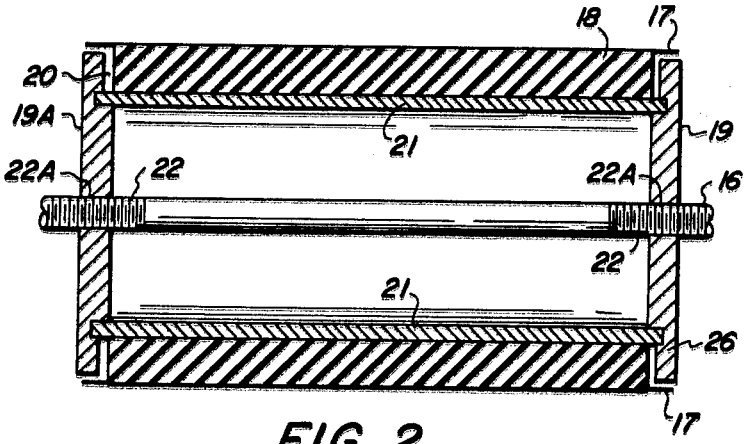
FIG. 2, shows in cross-section one resilient arcuate member.

Referring more specifically now to FIG. 2, there is shown in cross-section a resilient arcuate member in accordance with the present invention. In FIG. 2, the rigid shaft 16 is spaced apart from the flexible sleeve 17 by a resilient member 18. The resilient member 18 is adhesively attached to rigid plates 19 and 19a at attachment surfaces 20. In this embodiment, the resilient member 18 rests on rigid tube 21, however, the resilient member 18 may occupy all the space between the rigid shaft 16 and the flexible sleeve 17. In this exemplary embodiment the flexible sleeve 17 is an imaging surface and the resilient roll may be used as a xerographic member such as xerographic member 1 in FIG. 1. The imaging surface which comprises flexible sleeve 17 in FIG. 2 is a photoconductive material coated on a conductive flexible substrate.

Any suitable photoconductive material may be used. Selenium and selenium alloys are well known as being useful photoconductive materials. The photoconductive layer may comprise an inorganic or an organic photoconductive material. Typical inorganic materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfo-selenide and mixtures thereof. Typical organic photoconductors include: triphenylamine; 2,4-bis(4,4'-diethylamino-phenol)-1,3,4-oxadiazol; N-isopropylcarbazone; triphenylpyrrol; 4,5-diphenylimidazolidinone; 4,5-diphenylimidazolidinethione; 4,5-bis(4'-amino-phenyl)-imidazolidinone; 1,5-dicyanonaphthalene; 1,4-dicyanonaphthalene; aminophthalodinitrile; nitrophthalodinitrile; 1,2,5,6-tetraazacyclooctatetraene-(2,4,6,8); 2-mercaptobenzothiazole-2-phenyl-4-diphenylidene-oxazolone; 6-hydroxy-2,3-di(p-methoxy-phenyl)-benzofurane; 4-dimethylaminobenzylidene-benzhydrazide; 3,-benzylidene-amino-carbazole; polyvinyl carbazole; (2-nitrobenzylidene)-p-bromo-aniline; 2,4-diphenyl-quinazoline; 1,2,4-triazine; 1,5-diphenyl-3-methylpyrazoline 2-(4'-dimethyl-amino phenyl)-benzoxazole; 3-aminocarbazole; polyvinylcarbazole-trinitro-fluorenone.

The conductive flexible substrate may be made from any suitable material. Typical of such materials are brass, copper and aluminium.

Any suitable material may be used for the resilient member. Typical such materials are butyl rubber, neoprene rubber, nitrile rubber and silicone rubber sufficient to provide a hardness of from about 90° to about 30° (Shore A durometer) whenever the resilient arcuate surface is used in accordance with the teachings of S.C.P. Hwa as described above. Neoprene and silicone rubber are preferred because of their resistance to degradation by oil-based liquid developers.

Alternatively, the resilient arcuate member may be a developer applicator means as shown as roller 6 in FIG. 1. In such an embodiment, the flexible sleeve 17 may have a pattern of recesses in its surface sufficient to transport developer to an imaging surface. Such a flexible sleeve may be of any suitable material. Typical of such materials are aluminium, copper, rubber and brass. Aluminium is preferred because of its flexural strength.

Any suitable pattern of recesses may be formed in the surface of the flexible sleeve. Typical of such patterns are gravure-like depressions and grooves. A preferred type of recess is a multistart pattern of helically wound grooves because of the ease of machining such a pattern into the flexible sleeve surface.

The rigid plates may be formed from any suitable material. Typical such materials are steel, aluminium and brass.

Any suitable means may be used to attach the resilient means to the rigid plates. Typical of such means are adhesives and bolting devices. Adhesives are preferred because of the eveness of pull they provide when the rigid plates on either end of the resilient member are pulled apart.

In the exemplary embodiment of FIG. 2, the rigid shaft 16 has threaded portions 22 which match threaded portions 22*a* on rigid plates 19 and 19*a*. The threads are arranged so that whenever the rigid shaft 16 is turned in a specified direction, the rigid plates 19 and 19*a* are drawn apart. In operation the moving apart of the rigid plates 19 and 19*a* applies tension to the resilient member to reduce its diameter and to allow easy assembly of the resilient roller or replacement of the flexible sleeve. After the flexible sleeve has been properly positioned, the means for moving apart the plates is operated in a reverse mode so that the plates move together and the sleeve and the shaft are spaced apart by the resilient member. For example, in an embodiment similar to that shown in FIG. 2 wherein the roller diameter is about 5.5 inches and the resilient member thickness is about 0.5 inch, a total movement apart of the face plates by about 0.5 inch will reduce the resilient member diameter by about 0.05 inch to enable easy assembly or replacement of the flexible sleeve.

Figure 3:
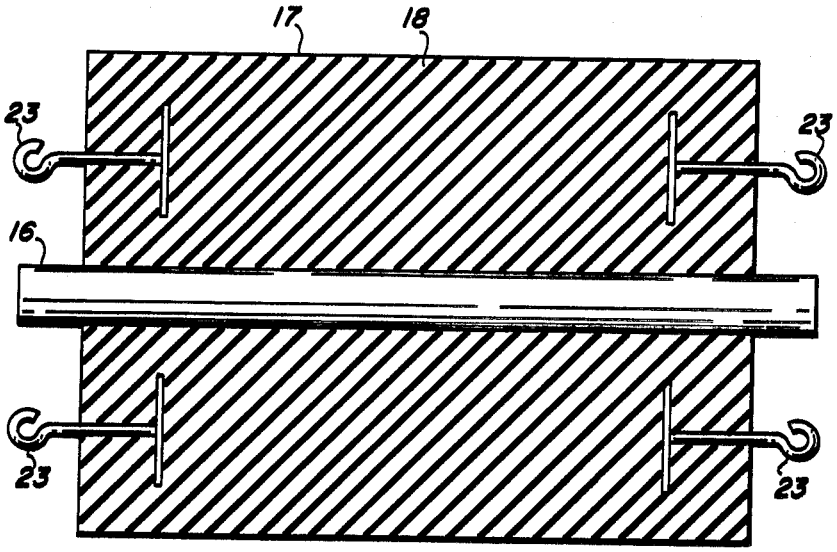
FIG. 3, shows in cross-section another resilient arcuate member.

Referring more specifically now to FIG. 3, there is shown another embodiment of a resilient arcuate member in accordance with the present invention.

In FIG. 3, there is shown a resilient member 18 which spaces apart rigid shaft 16 and flexible sleeve 17. Flexible surface 17 in this embodiment is an applicator surface as described in connection with FIG. 2. Hooks 23 have one end embedded in the resilient member 18 and an operative end available for connection with a tensioning means (not shown). When under suitable tension the resilient member 18 will stretch so that its spacing dimension is reduced an amount sufficient for the flexible surface 17 to be easily moved with respect to the resilient member. When the flexible surface 17 is properly positioned, the tension may be released so that the surface 17 is positively spaced apart from the rigid shaft 16.

Referring more specifically now to FIGS. 4*a* and 4*b* there is shown in perspective another embodiment of the resilient arcuate member of the present invention. Resilient member 24 in FIG. 4*a* spaces apart the support member 25 and flexible surface 26. In FIG. 4*a* the resilient member 24 is in a relaxed state and is under sufficient compression between the flexible surface 26 and the support member 25 to impart a firmness to the flexible surface 26 and to prevent the flexible surface 26 and the support member from moving easily with respect to each other. In FIG. 4*b*, the resilient member 24 has been tensioned in the direction of the resilient member 24 which is reduced. Any suitable means of tensioning may be used. As can be seen, the reduction of the spacing dimension makes the resilient member 24 unable to prevent easy movement of the flexible surface 26 with, respect to the support member 25.

Other means of moving the rigid plates apart will be obvious to those skilled in the art.

While the invention has been described and shown with reference to preferred embodiments and uses thereof other modifications and ramifications of the present invention will occur to those skilled in the art upon reading the disclosure. These are intended to be included within the scope of the invention.

What is claimed is:

1. A resilient arcuate member which comprises a rigid support member, a flexible arcuate imaging member comprising a photoconductive material coated on a conductive flexible substrate, a resilient member which separates said support and said imaging member and a means for tensioning the resilient member in such a way that separation results in a spacing dimension reduced in an amount sufficient to allow easy movement of the flexible surface with respect to the resilient member.

2. The resilient arcuate member of claim 1, wherein the photoconductive material is selected from the group consisting of selenium and selenium alloys.

3. The resilient arcuate member of claim 1, wherein the conductive substrate of the flexible arcuate imaging member is selected from the group consisting of brass, copper and aluminum.

4. The resilient arcuate member of claim 1, wherein the means for tensioning the resilient member comprise rigid plates attached to both ends of the resilient member.

5. The resilient arcuate member of claim 4, wherein the rigid plates are adhesively attached to the resilient member.

6. The resilient arcuate member of claim 1, wherein the means for tensioning the resilient member comprises at least one rigid connecting means at each end of the resilient means, one end of which is embedded in the resilient member.

7. The resilient arcuate member of claim 1, wherein the surface has a Shore A durometer hardness of from about 30° to about 90°.

8. The resilient arcuate member of claim 1, wherein the resilient member is selected from the group consisting of butyl rubber, neoprene rubber, nitrile rubber and silicone rubber.

* * * * *